US011108147B2

(12) United States Patent
Ikuta et al.

(10) Patent No.: US 11,108,147 B2
(45) Date of Patent: Aug. 31, 2021

(54) ANTENNA PROTECTOR

(71) Applicant: Honda Motor Co., Ltd., Tokyo (JP)

(72) Inventors: Koji Ikuta, Utsunomiya (JP); Takaaki Ito, Shioyagun (JP); Takashi Matsumoto, Utsunomiya (JP); Daniel Ryan McDaniel, Columbus, OH (US); Masashi Naradate, Utsunomiya (JP); Manabu Oshima, Utsunomiya (JP); Kei Suzuki, Moka (JP)

(73) Assignee: Honda Motor Co., Ltd., Tokyo (JP)

( * ) Notice: Subject to any disclaimer, the term of this patent is extended or adjusted under 35 U.S.C. 154(b) by 456 days.

(21) Appl. No.: 16/188,854

(22) Filed: Nov. 13, 2018

(65) Prior Publication Data

US 2020/0153091 A1 May 14, 2020

(51) Int. Cl.

| | |
|---|---|
| ***H01Q 1/40*** | (2006.01) |
| ***H01Q 1/42*** | (2006.01) |
| ***H01Q 1/14*** | (2006.01) |
| ***H01Q 1/12*** | (2006.01) |
| ***H01Q 1/32*** | (2006.01) |

(52) U.S. Cl.
CPC ..... *H01Q 1/42* (2013.01); *H01Q 1/1221* (2013.01); *H01Q 1/14* (2013.01); *H01Q 1/3275* (2013.01); *H01Q 1/40* (2013.01)

(58) Field of Classification Search
None
See application file for complete search history.

(56) References Cited

U.S. PATENT DOCUMENTS

| | | | | |
|---|---|---|---|---|
| 4,728,962 | A * | 3/1988 | Kitsuda | H01Q 1/38 343/700 MS |
| 6,489,927 | B2 * | 12/2002 | LeBlanc | H01Q 25/00 343/713 |
| 6,744,399 | B2 * | 6/2004 | Tohyama | H01Q 1/3233 342/165 |
| 7,466,280 | B2 * | 12/2008 | Noro | H01Q 1/1207 343/711 |
| 7,675,460 | B2 * | 3/2010 | Sanada | G01S 7/4026 342/173 |
| 7,988,212 | B2 * | 8/2011 | Hartley | B60R 19/483 293/117 |
| 9,676,424 | B2 * | 6/2017 | Ito | B62D 25/24 |

(Continued)

FOREIGN PATENT DOCUMENTS

| | | | |
|---|---|---|---|
| JP | 3470509 | B2 | 11/2003 |
| JP | 4550297 | B2 | 9/2010 |
| JP | 4801439 | B2 | 10/2011 |

*Primary Examiner* — Ab Salam Alkassim, Jr.
(74) *Attorney, Agent, or Firm* — American Honda Motor Co., Inc.; Morgan Lincoln

(57) ABSTRACT

An antenna protector includes a top wall, a first side wall, a second side wall, and an end wall. The top wall includes a center reinforcement that includes a plurality of lateral ribs and longitudinal ribs protruding from the top wall and arranged in a grid formation. Each of the first side wall, the second side wall, and the end wall include a perimeter reinforcement that includes a plurality of vertical ribs protruding from the wall. In an exemplary embodiment the antenna protector may include an open end portion, a closed end portion, and a center section, wherein the center section is narrower in width than each of the open end portion and the closed end portion.

5 Claims, 10 Drawing Sheets

(56) References Cited

U.S. PATENT DOCUMENTS

| | | | | |
|---|---|---|---|---|
| 2006/0176235 | A1* | 8/2006 | Gotti | H01Q 1/52 343/872 |
| 2010/0090923 | A1* | 4/2010 | Sato | H01Q 1/3275 343/872 |
| 2010/0194662 | A1* | 8/2010 | Saddington | H01Q 1/42 343/872 |
| 2013/0206447 | A1* | 8/2013 | Iio | H02G 3/0487 174/68.3 |
| 2015/0318608 | A1* | 11/2015 | Tran | H01Q 1/3233 343/872 |
| 2020/0036092 | A1* | 1/2020 | Su | H01Q 1/02 |

* cited by examiner

ANTENNA PROTECTOR

BACKGROUND

Passenger vehicles are often equipped with a remote entry feature wherein the vehicle automatically performs certain functions as a passenger approaches or leaves the vehicle with a proximity key fob. Some of these functions may include locking/unlocking, and opening/closing of an entry door. In order for this feature to operate, an antenna, such as a low frequency antenna, may be positioned within the vehicle to receive a signal from the proximity key fob indicating presence of the key fob near the vehicle. The antenna is connected to the vehicle's control systems through a wiring harness.

The specific position of the antenna within the vehicle is important for operation of the remote entry feature, because factors such as distance and the presence of obstructions may affect the ability of the antenna to detect the proximity key fob. To mitigate these factors, the antenna is often placed in an area of the vehicle where detection of the proximity key fob is optimized. An example of a location where an antenna may be installed is a floor panel in a trunk area of the vehicle. However, the trunk area is also a location where passengers often place heavy and/or sharp objects for transport within the vehicle.

A current solution for protecting the antenna and wiring harness from damage includes an antenna protector. The antenna protector is often a molded plastic part fastened to a vehicle panel and configured to cover the antenna and wiring harness. The antenna protector offers protection to the antenna and wiring harness from heavy and/or sharp objects placed on or nearby by providing a physical barrier over the various components. The strength of the antenna protector is often known to be directly related to the thickness of the material comprising its structural walls.

There is a need for lighter vehicle components to reduce overall vehicle weight while retaining or increasing the strength of the components. With regards to the antenna protector, there is opportunity to reduce weight by utilizing thinner, and therefore lighter, structural walls that utilize structural reinforcements rather than thicker material to provide strength.

BRIEF SUMMARY

According to one aspect, an antenna protector includes a top wall, a first side wall, a second side wall, an end wall, and a mounting flange. A perimeter reinforcement that includes a vertical rib is disposed on the first side wall, the second side wall, and the end wall. A center reinforcement that includes structural ribs comprising a lateral rib and a longitudinal rib is disposed on the top wall.

According to another aspect, an antenna protector includes a top wall, a first side wall, a second side wall, and an end wall. The top wall has a center reinforcement that includes a plurality of a lateral rib and plurality of a longitudinal rib arranged in a grid formation. Each of the first side wall, the second side wall, and the end wall include a plurality of a vertical rib positioned parallel to one another. The antenna protector comprises a plastic material and is configured to mount to a vehicle panel in a trunk area of a vehicle.

According to another aspect, an antenna system includes an antenna, a wiring harness, and an antenna protector. The antenna protector includes an open end portion, a closed end portion, a center section, a center reinforcement and a perimeter reinforcement. The center section is narrower in width than each of the open end portion and the closed end portion. The center reinforcement includes structural ribs that include a plurality of a lateral rib and a plurality of a longitudinal rib. The perimeter reinforcement includes a plurality of a vertical rib.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Description

With reference now to the figures wherein the illustrations are for purposes of illustrating one or more exemplary embodiments and not for purposes of limiting the same, there is shown an antenna protector for a vehicle.

Figure 1:
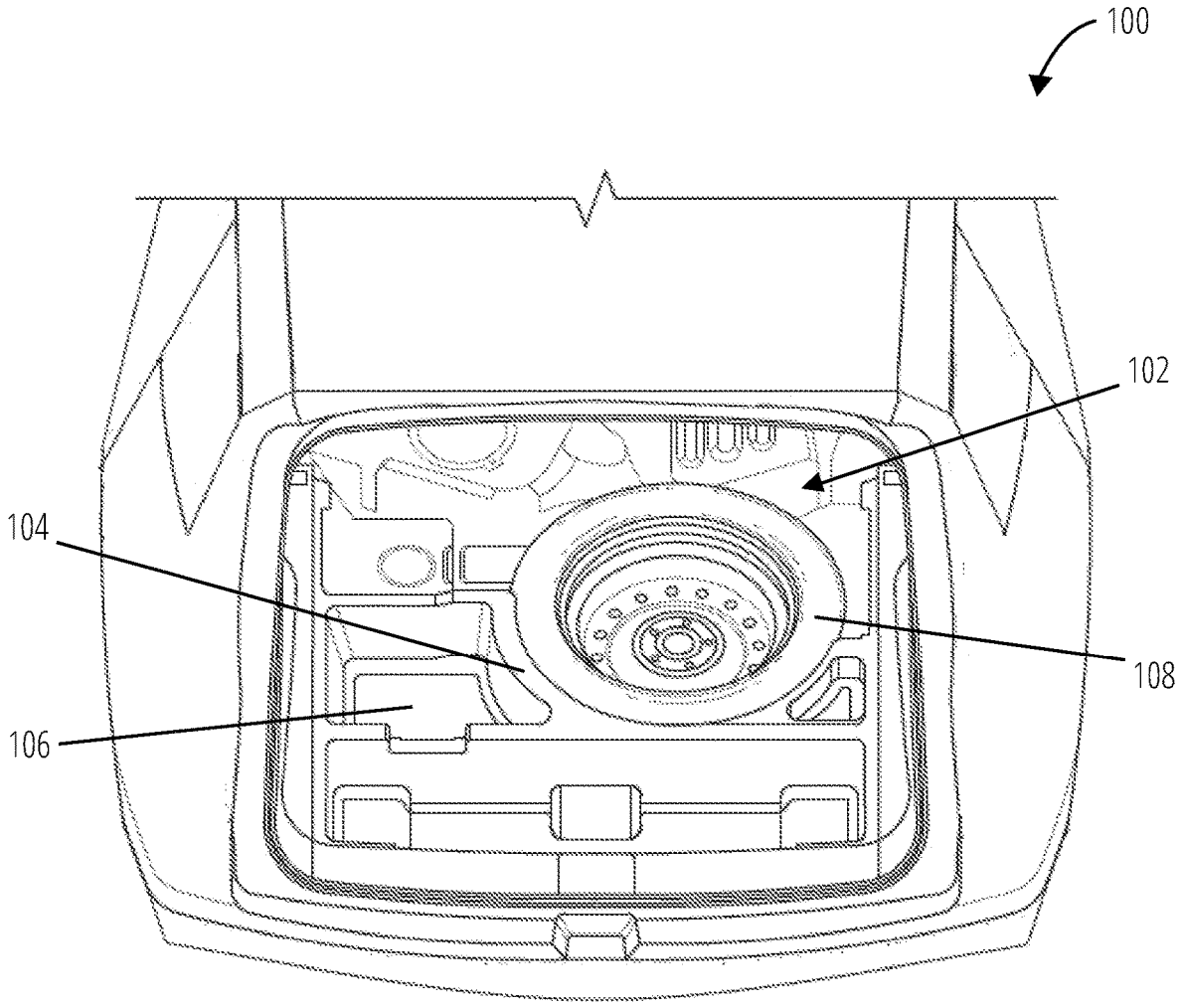
FIG. 1 is a perspective view of a trunk area of a vehicle according to an exemplary embodiment.

FIG. 1 shows a perspective view of a trunk area 102 of a vehicle 100 according to an exemplary embodiment. The trunk area 102 is an example of an environment wherein the antenna protector may be installed. The trunk area 102 is accessible through an opening at a rear of the vehicle 100. The opening to the trunk area 102 may be covered by a trunk lid or tailgate (not shown) to enclose the rear of the vehicle 100. The body style of the depicted vehicle 100 is that of a sport utility vehicle, but the body style may be a sedan, coupe, truck, or any other body style of vehicle in other embodiments.

In the depicted embodiment, the trunk area 102 includes a trunk liner 104 and a spare tire 108. The trunk liner 104 may include a storage compartment 106 for storing items, or may alternatively remain flat to provide a flat working surface at the trunk area 102. The spare tire 108 may be positioned adjacent the trunk liner 104, or may alternatively be positioned on top of the trunk liner 104 in other embodiments. Alternatively, the spare tire 108 may be mounted on an exterior surface of the vehicle 100. Although the trunk area 102 is shown as an exemplary environment for the antenna protector, the antenna protector may also be installed in other areas of a vehicle, such as a floorboard or a foot well in a vehicle passenger compartment, for example.

Figure 2:
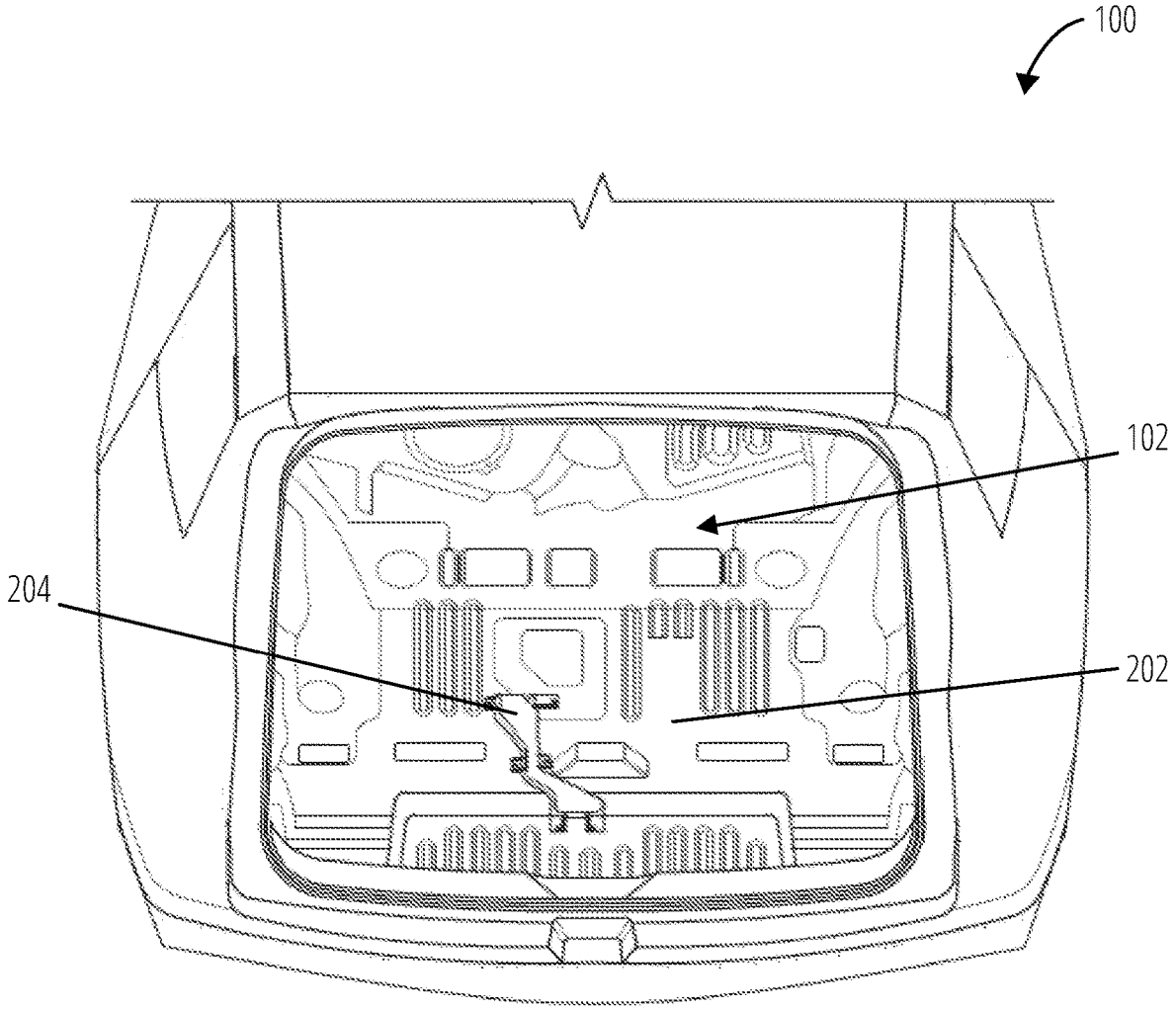
FIG. 2 is a perspective view of an antenna protector according to an exemplary embodiment positioned in the vehicle in FIG. 1.

FIG. 2 shows a perspective view of an antenna protector 204, according to an exemplary embodiment, positioned in the trunk area 102 of the vehicle 100. The trunk liner 104 and spare tire 108 are removed in FIG. 2 to show the position of the antenna protector 204 relative to a trunk floor 202. The antenna protector 204 is mounted directly to the trunk floor 202 and located under the trunk liner 104 in the depicted embodiment. The antenna protector 204 may be positioned on another body panel in the vehicle 100 in other embodiments, such as a cabin floor panel, a door panel, a roof panel, or a bumper, for example.

The antenna protector 204 is molded as one piece using a lightweight material. According to one embodiment, the antenna protector 204 comprises a plastic material. However, the antenna protector 204 may comprise another lightweight material, such as aluminum for example, in other embodiments.

Figure 3:
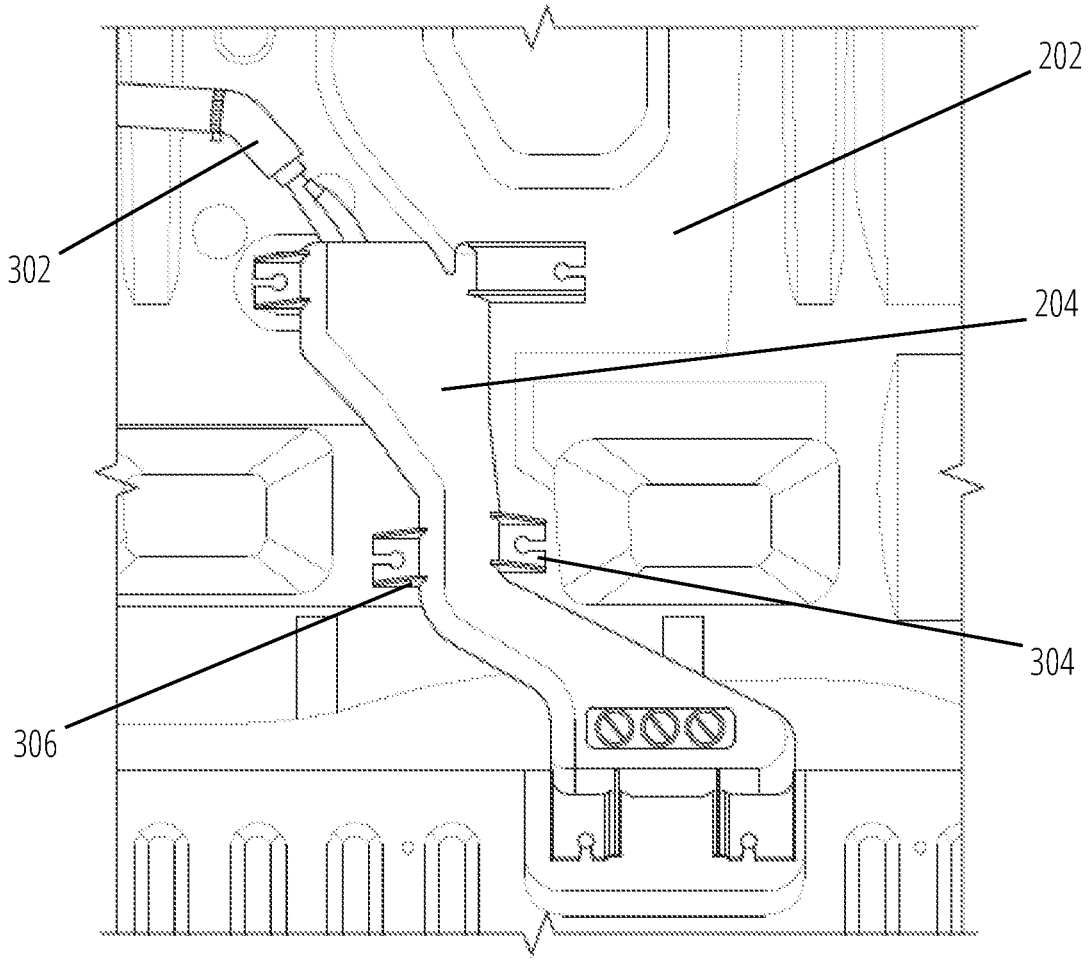
FIG. 3 is a top view of the antenna protector in FIG. 2 positioned over a wiring harness.

FIG. 3 shows a top view of the antenna protector 204 positioned over a wiring harness 302 and mounted to the trunk floor 202. As shown in FIG. 3, the antenna protector 204 is positioned on the trunk floor 202 and mounted at a mounting flange 304 extending from an outside wall of the antenna protector 204. The wiring harness 302 is also mounted on the trunk floor 202, and the antenna protector 204 is positioned over the wiring harness 302. The antenna protector 204 covers a substantial portion of the wiring harness 302, however a small portion of the wiring harness 302 extends from an end of the antenna protector 204. In other embodiments, the antenna protector may fully cover the wiring harness 302.

The depicted embodiment includes six of the mounting flange 304 at various points around a perimeter of the antenna protector 204. Other embodiments may include fewer mounting flanges or more mounting flanges to secure the antenna protector 204 to a vehicle panel. For example, a larger antenna protector may include more than six mounting flanges, while a smaller antenna protector may include fewer than six mounting flanges. The mounting flange 304 is substantially rectangular in shape as viewed in FIG. 3, however the mounting flange 304 may comprise other shapes such as a semi-circle in other embodiments. The mounting flange 304 also includes a gusset 306 for reinforcement.

Figure 4:
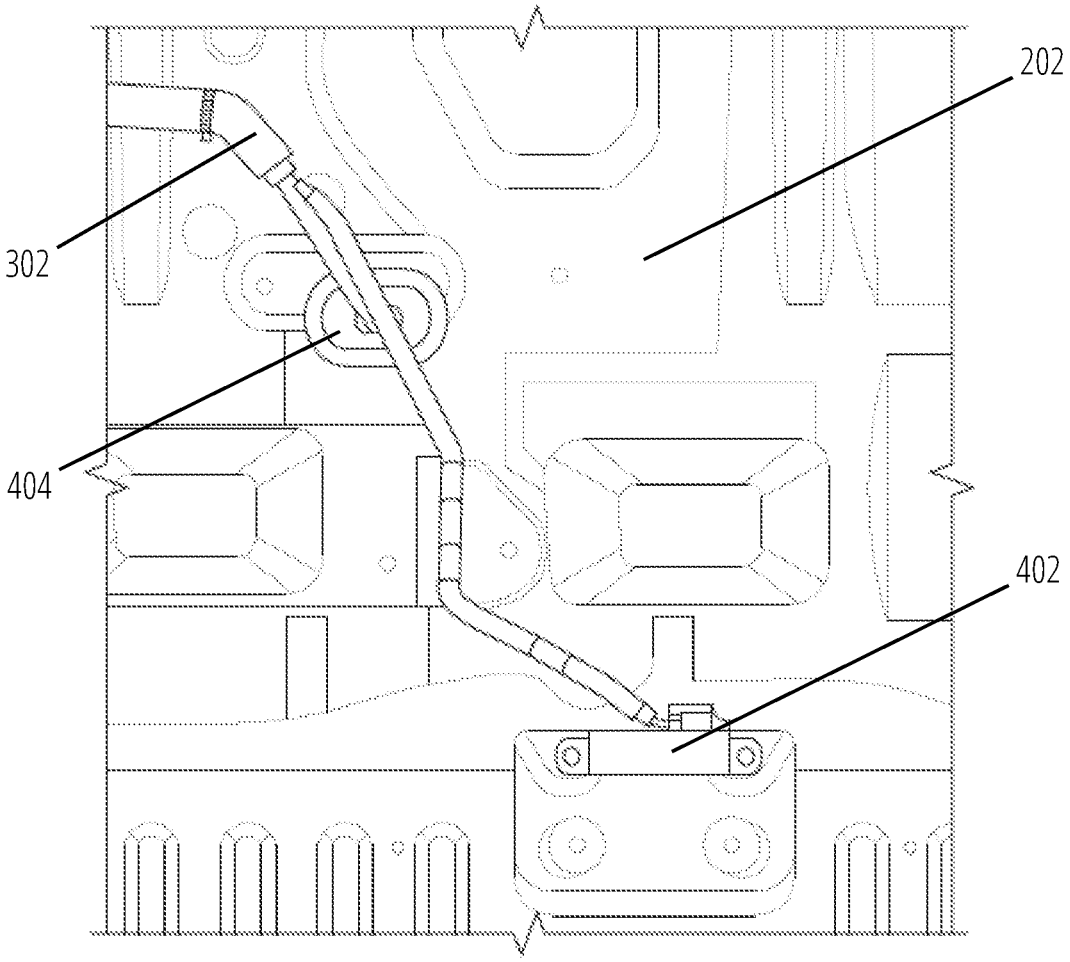
FIG. 4 is a top view of the wiring harness in FIG. 3.

FIG. 4 shows a top view of the wiring harness 302 mounted to the trunk floor 202, without the antenna protector 204 shown in FIG. 3. At an end of the wiring harness 302 is an antenna 402. According to one embodiment, the antenna 402 may comprise a low-frequency antenna, however the antenna 402 may comprise any other type of antenna that is mounted to a vehicle panel in a similar configuration. The low-frequency antenna is a type of antenna often operating in a radio frequency range of 30 kilohertz (kHz) to 300 kHz. Also shown in FIG. 4 is a grommet 404 wherein an additional wire joins the wiring harness 302 from an opposing side of the trunk floor 202. The wire may be coupled to an additional antenna located on an exterior surface of the vehicle 100, or may alternatively be coupled to a different component that includes wiring routed to a similar area of the vehicle as the wiring of the antenna 402. In other embodiments there may be more grommet 404 or additional wiring, or there may be no grommet 404 or additional wiring joining the wiring harness 302 beneath the antenna protector 204.

Figure 5:
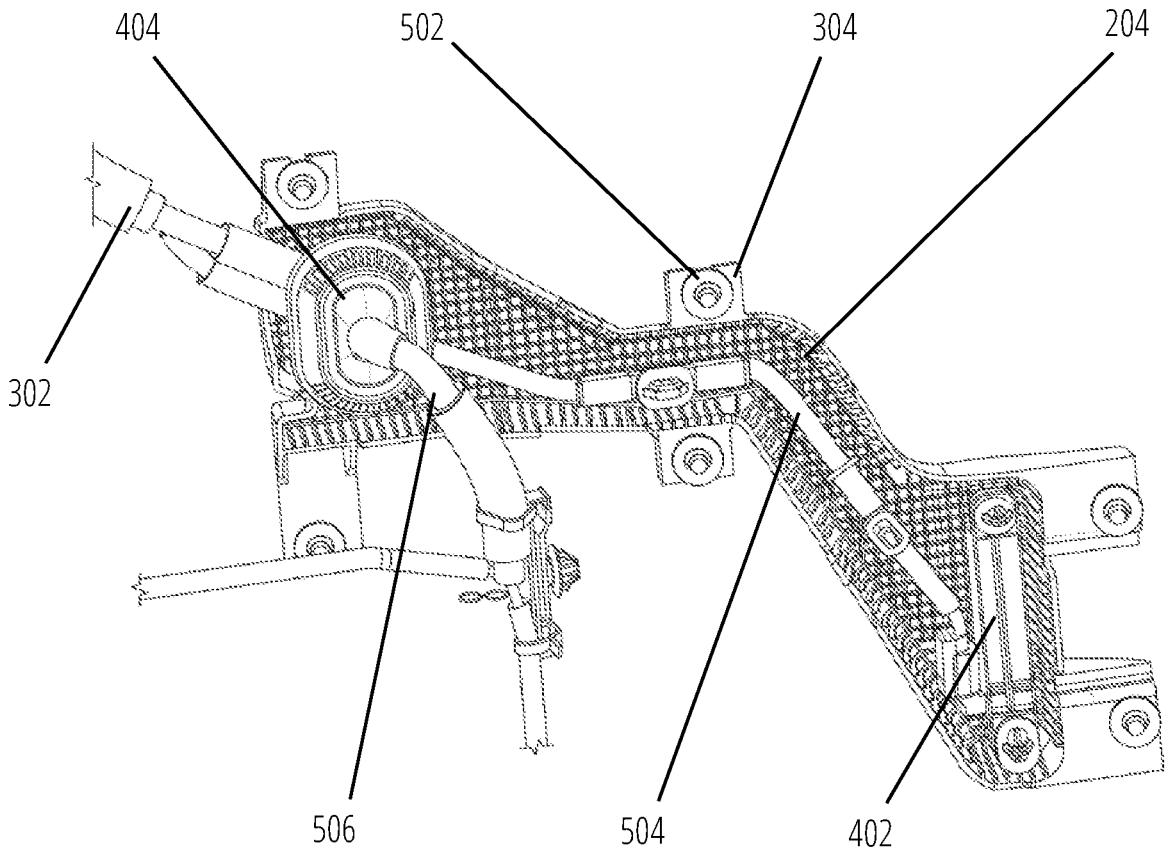
FIG. 5 is a bottom view of the antenna protector and wiring harness in FIG. 3.

FIG. 5 shows a bottom view of the antenna protector 204, along with the antenna 402 and the wiring harness 302 positioned within a cavity of the antenna protector 204. A small portion of the wiring harness 302 is exposed outside of the coverage area of the antenna protector 204. A first wire 504 is connected to the antenna 402 positioned at one end of the antenna protector 204, and a second wire 506 joins the wiring harness 302 through the grommet 404 at another end of the antenna protector 204. Also shown is a mounting clip 502 positioned at each mounting flange 304. The mounting clip 502 fastens the antenna protector 204 to the trunk floor 202 to prevent movement. The mounting clip 502 is a plastic retainer clip in the depicted embodiment, but may comprise a screw, bolt, or other known vehicle component fastening mechanism in other embodiments.

Figure 6:
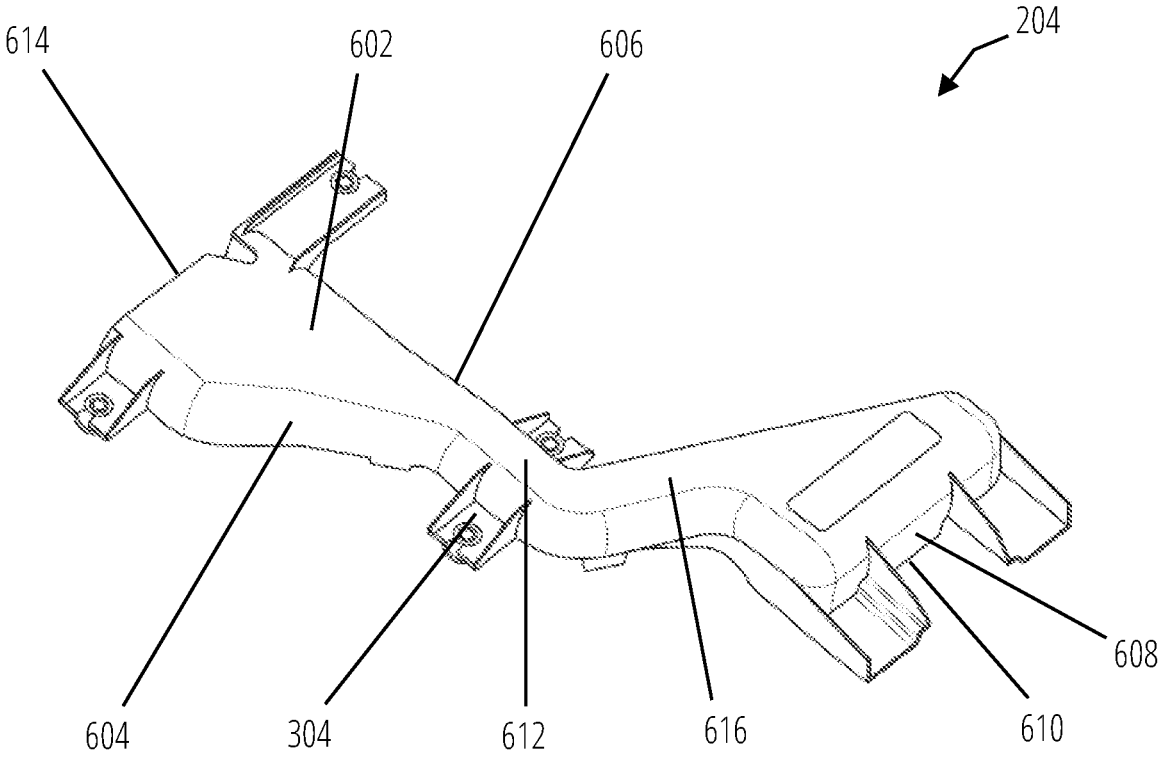
FIG. 6 is a top perspective view of the antenna protector in FIG. 2.

FIG. 6 shows a top perspective view of the antenna protector 204. The antenna protector 204 includes a top wall 602, a first side wall 604, a second side wall 606 opposite the first side wall 604, and an end wall 608. Each of the walls includes structural reinforcement, as will be described with respect to following figures, to offer protection to the antenna 402 and wiring harness 302 from impacts and heavy loads. As stated, the depicted embodiment is positioned in the trunk area 102 of the vehicle 100, however other embodiments may be positioned in other areas of the vehicle where an antenna 402 is present.

The antenna protector 204 may be described with respect to three regions or portions: a closed end portion 610, a center section 612, and an open end portion 614 at an opposite end of the antenna protector 204 from the closed end portion 610. The antenna 402 is positioned in the closed end portion 610, coinciding with the end wall 608 in the disclosed embodiment. The wiring harness 302 is routed through the center section 612 and extends beyond the antenna protector 204 at the open end portion 614. In other words, the center section 612 connects the closed end portion 610 to the open end portion 614.

The center section 612 is narrower in width than either of the closed end portion 610 and the open end portion 614. In other words, each of the closed end portion 610 and the open end portion 614 widen relative to the center section 612. Further, the center section 612 includes an angled portion 616 configured to laterally offset the closed end portion 610 from the center section 612.

Each of the closed end portion 610, center section 612 and open end portion 614 include two of the mounting flange 304 in the disclosed embodiment. In other embodiments, each of the regions may include fewer or more mounting flanges to accommodate differing sizes and shapes of each region. For example, an antenna protector having a longer center section than the depicted embodiment may include four mounting flanges at its center section and maintain two mounting flanges at each of its closed end portion and open end portion.

Figure 7:
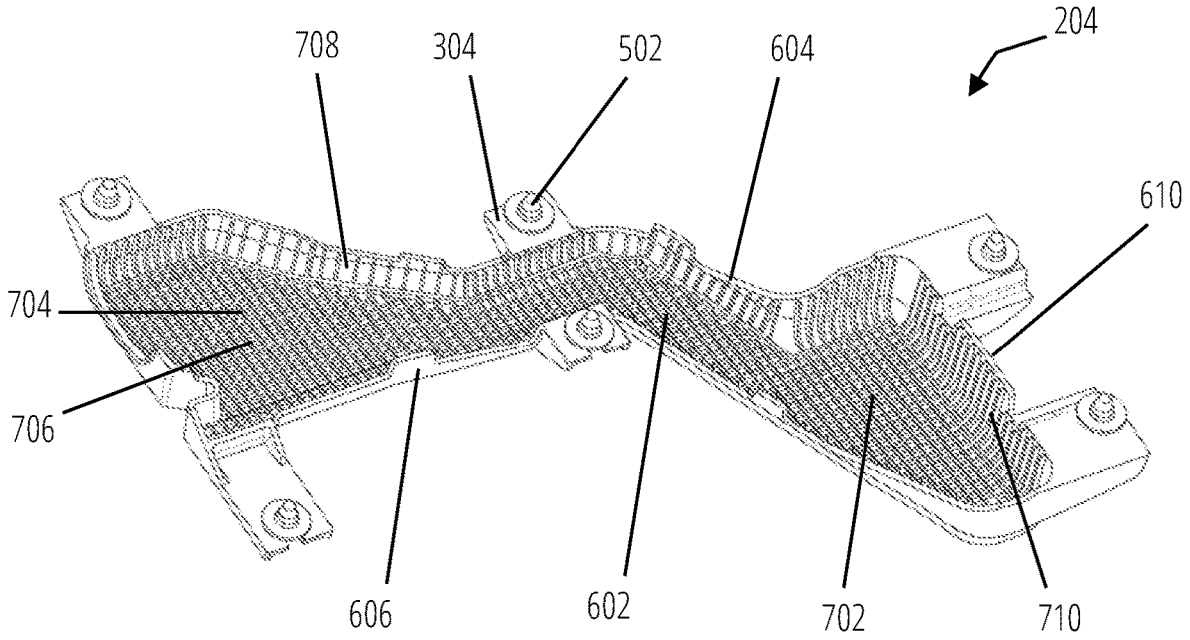
FIG. 7 is a bottom perspective view of the antenna protector in FIG. 2.

FIG. 7 shows a bottom perspective view of the antenna protector 204. The structural reinforcement of the top wall 602 comprises a center reinforcement 702 including a plurality of lateral rib 704 and a plurality of longitudinal rib 706. As shown, the plurality of lateral rib 704 and longitudinal rib 706 are configured in a grid formation that will be described further with respect to following figures. The first side wall 604, second side wall 606, and end wall 608 each include a structural reinforcement comprising a perimeter reinforcement 708 that includes vertical rib 710. A plurality of vertical rib 710 are arranged parallel to one another. The center reinforcement 702 and the perimeter reinforcement 708 are configured to provide structural rigidity to the antenna protector 204 to prevent the top wall 602 from deflecting downward towards the wiring harness 302 and antenna 402 when the antenna protector 204 is mounted in the position provided in FIG. 3 over the wiring harness 302 and antenna 402.

Figure 8:
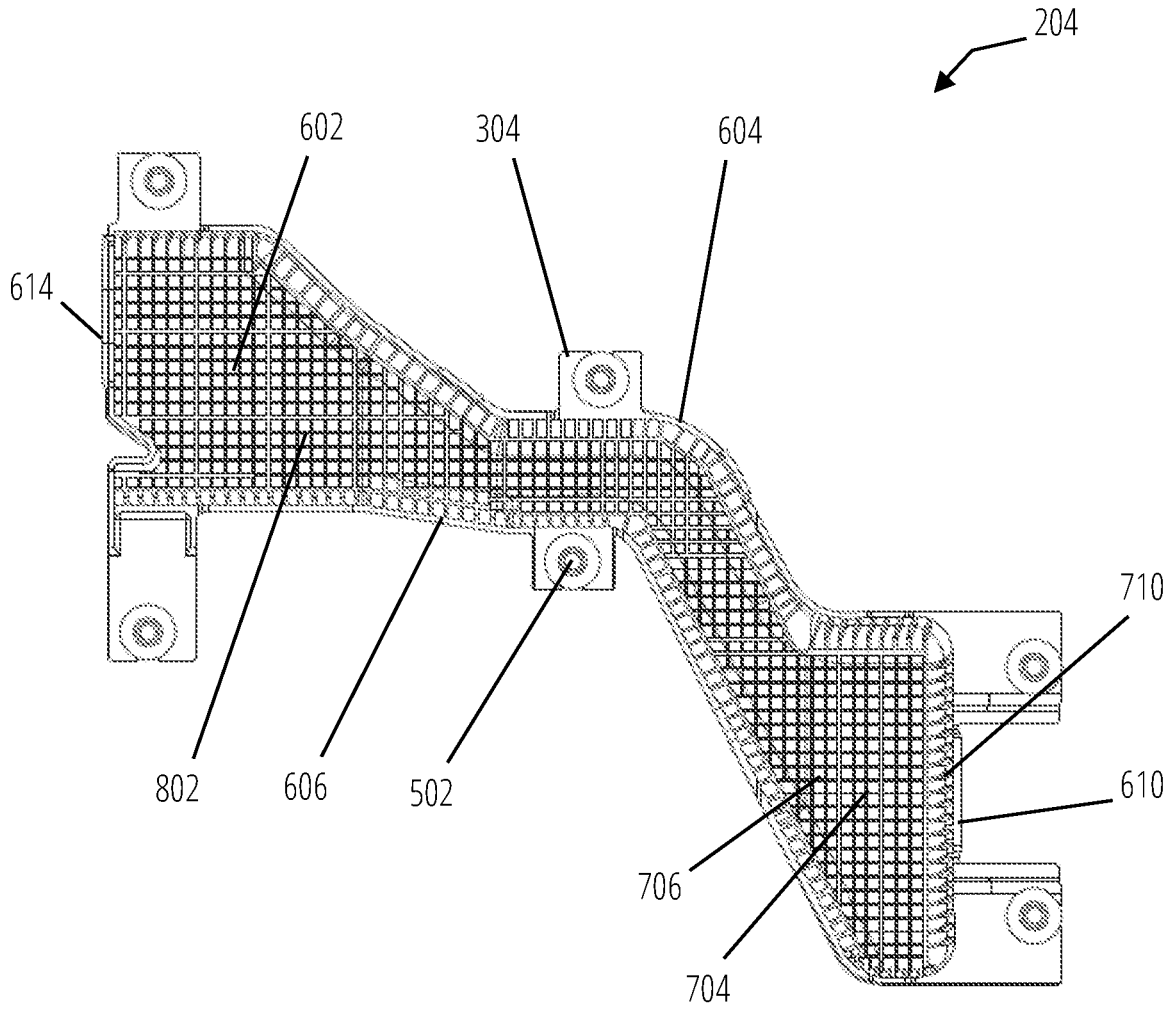
FIG. 8 is a bottom view of the antenna protector in FIG. 2.

FIG. 8 shows a bottom view of the antenna protector 204. As previously described and shown in FIG. 8, a grid formation 802 comprising a plurality of both the lateral rib 704 and the longitudinal rib 706 are included in the center reinforcement 702.

Figure 9:
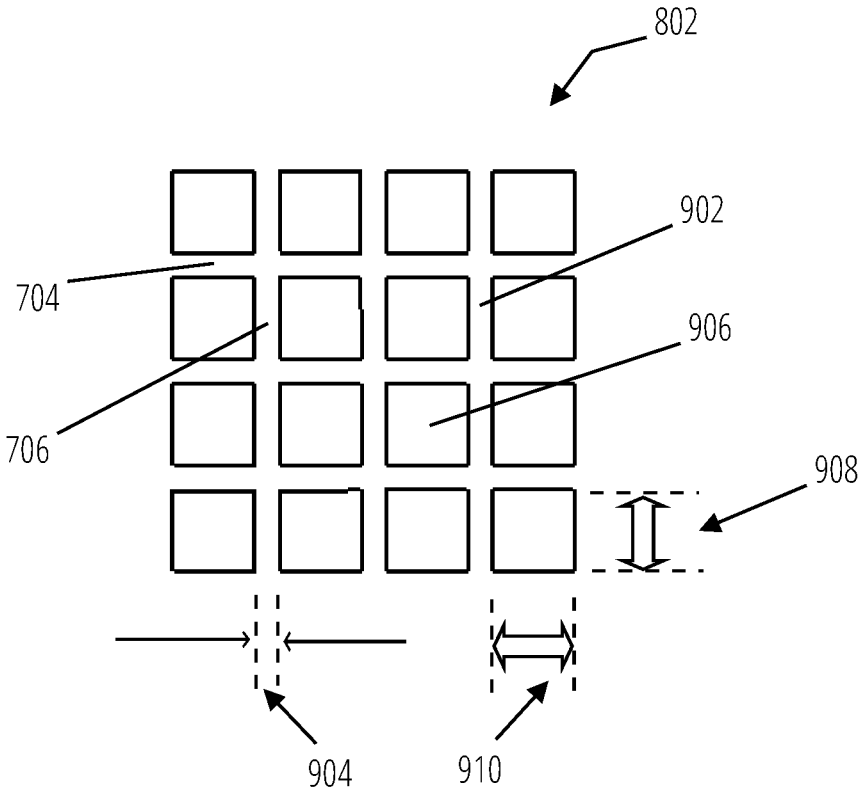
FIG. 9 is a plan view of structural ribs in a grid formation according to an exemplary embodiment.

FIG. 9 shows a plan view of structural ribs in the grid formation 802 according to an exemplary embodiment. The lateral rib 704, longitudinal rib 706, and vertical rib 710 each comprise a rib wall 902 having a rib wall thickness 904. In the disclosed embodiment the rib wall thickness 904 is approximately 1.2 mm, however the rib wall thickness 904 may be between approximately 1.0 and 1.4 mm in other embodiments.

As previously described and further shown in FIG. 9, the grid formation 802 comprises a plurality of the lateral rib 704 and the longitudinal rib 706. The configuration of a plurality of the lateral rib 704 and the longitudinal rib 706 perpendicular to one another defines a grid aperture 906. The grid aperture 906 further includes a grid aperture length 908 and a grid aperture width 910 defining a distance from one of the lateral rib 704 and longitudinal rib 706 to a parallel lateral rib 704 and longitudinal rib 706, respectively. The grid aperture length 908 is measured along an axis extending substantially from the open end portion 614 to the closed end portion 610, and the grid aperture width 910 is measured along an axis extending substantially from the first side wall 604 to the second side wall 606. The grid aperture 906 is substantially square in the disclosed embodiment, wherein the grid aperture length 908 is substantially equal to the grid aperture width 910. For example, the grid aperture length 908 and the grid aperture width 910 are each approximately 4.0 mm in the disclosed embodiment. However, the grid aperture 906 may comprise a rectangle or any other quadrilateral shape in other embodiments as needed to accommodate a specific perimeter shape of the top wall 602. As such, each of the grid aperture length 908 and the grid aperture width 910 may be between approximately 2.0 and 6.0 mm in other embodiments, and may not be equal to one another.

Figure 10:
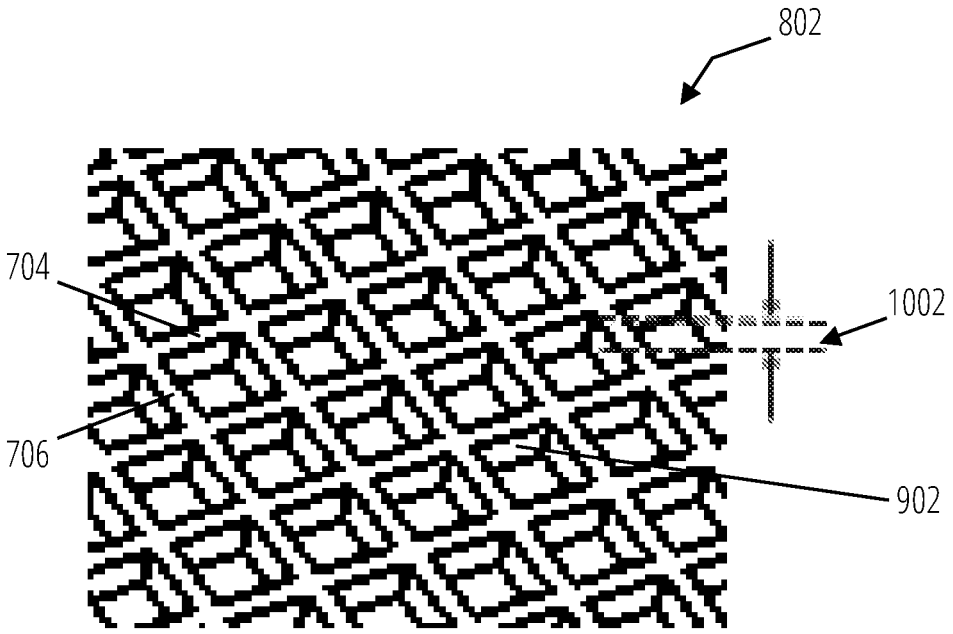
FIG. 10 is a perspective view of the structural ribs in FIG. 9.

FIG. 10 shows a perspective view of structural ribs in the grid formation 802 provided in FIG. 9. Each of the lateral rib 704 and the longitudinal rib 706 includes a rib wall height 1002. The rib wall height 1002 may be between approximately 2.0 and 3.0 mm as desired for a specific application.

The dimensions of the rib wall thickness 904 and the rib wall height 1002, along with the grid aperture length 908 and the grid aperture width 910 may be varied within the provided ranges to obtain a desired weight and stiffness quality of the center reinforcement 702. For example, a narrower rib wall thickness 904 and shorter rib wall height 1002 may be provided in an application that will not benefit from heavy reinforcement, providing a benefit of lighter weight; alternatively, a thicker rib wall thickness 904 and taller rib wall height 1002 may be provided in an application that will benefit from heavy reinforcement.

The foregoing detailed description of exemplary embodiments is included for illustrative purposes only. It should be understood that other embodiments could be used, or modifications and additions could be made to the described embodiments. Therefore, the disclosure is not limited to the embodiments shown, but rather should be construed in breadth and scope in accordance with the recitations of the appended claims.

What is claimed is:

1. An antenna system, comprising:

an antenna;

a wiring harness; and an antenna protector that includes:

an open end portion, a closed end portion, and a center section; wherein the center section is narrower in width than each of the open end portion and the closed end portion;

a center reinforcement comprising structural ribs that include a plurality of a lateral rib and a plurality of a longitudinal rib; and a perimeter reinforcement comprising a plurality of a vertical rib.

2. The antenna system of claim 1, wherein the antenna protector fully covers the antenna and partially covers the wiring harness with respect to a vehicle panel.

3. The antenna system of claim 1, wherein the antenna comprises a low-frequency antenna.

4. The antenna system of claim 1, wherein the plurality of the lateral rib and the plurality of the longitudinal rib are configured in a grid formation.

5. The antenna system of claim 1, wherein the antenna protector comprises a plastic material.

* * * * *